US006448879B1

(12) United States Patent
Kitamura

(10) Patent No.: US 6,448,879 B1
(45) Date of Patent: Sep. 10, 2002

(54) COIL COMPONENT

(75) Inventor: Hidekazu Kitamura, Shiga-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/212,638

(22) Filed: Dec. 16, 1998

(30) Foreign Application Priority Data

Dec. 18, 1997 (JP) ..... 9-349246
Sep. 28, 1998 (JP) ..... 10-291485

(51) Int. Cl.[7] ..... H01F 5/00
(52) U.S. Cl. ..... 336/200; 336/83
(58) Field of Search ..... 336/200, 83, 183, 336/232

(56) References Cited

U.S. PATENT DOCUMENTS 4,322,698 A * 3/1982 Takahashi et al. ..... 333/184
4,959,631 A * 9/1990 Hasegawa et al. ..... 336/83

FOREIGN PATENT DOCUMENTS

JP 8-203737 8/1996

* cited by examiner

*Primary Examiner*—Lincoln Donovan
*Assistant Examiner*—Tuyen T. Nguyen
(74) *Attorney, Agent, or Firm*—Keating & Bennett, LLP

(57) ABSTRACT

A coil component uses a magnetic material having a relative permeability of a specified value or more which permits deviations in inductance to vary within a narrow range, even if the magnetic substrate material has a relative permeability having large deviations. The coil component includes a pair of magnetic substrates, non-magnetic layers and a coil. The non-magnetic layers and the coil are laminated between the magnetic substrates. A relative permeability of a material of the magnetic substrates is set such that a combined magnetic resistance R1 of the magnetic substrates which define a closed series magnetic circuit including the pair of magnetic substrates and the non-magnetic layers, and a combined magnetic resistance R2 of the non-magnetic layers have a relationship: R2>R1.

12 Claims, 4 Drawing Sheets

COIL COMPONENT

BACKGROUND OF THE INVENTION

1. Field of the Invention

The present invention relates to a coil component in which deviations in inductance of the coil component are restricted to a narrow range when a material having large deviations in relative permeability is used for forming a magnetic substrate for a coil, a transformer, or other electronic component.

2. Description of the Related Art

A conventional type of coil component is disclosed in Japanese Unexamined Patent Publication No. 8-203737. This coil component prevents deterioration of electric characteristics caused by shrinkage of a green sheet, which is a magnetic substance, which occurs during a firing process, by means of interposing a non-magnetic layer (an insulation layer) having a coil pattern disposed thereon between a pair of magnetic substrates.

The conventional type of coil component, however, has a disadvantage. That is, overall inductance of the coil component varies greatly when a material having large deviations in relative permeability is used as a magnetic substrate material for the coil component. This is because many of the conventional materials for a magnetic substrate which have been on the market are of a type in which the relative permeability varies within a range of about ±30% from a standard value. Thus, the inductance of a coil component produced by such a material, similarly, varies within a range of about ±30% from a standard value.

SUMMARY OF THE INVENTION

To overcome the problems described above, the preferred embodiments of the present invention provide a coil component in which deviations in an overall inductance of the coil component is significantly reduced to fall within a range of about ±5%, by using a magnetic substrate material in which the relative permeability has deviations within a range of ±30% but is equal to or greater than a specified desired value.

According to a first aspect of preferred embodiments of the present invention, there is provided a coil component which includes a pair of magnetic substrates, non-magnetic layers and a coil, the non-magnetic plates and the coil being laminated between the magnetic substrates, wherein a relative permeability of a material of the magnetic substrates is set in such a manner that a combined magnetic resistance R1 of the magnetic substrates arranged to define a closed series magnetic circuit including the pair of magnetic substrates and the non-magnetic layers, and a combined magnetic resistance R2 of the non-magnetic layers have a relationship: R2>R1.

In preferred embodiments of the invention, the use of a material, having a relative permeability of a specified desired value or more, as a magnetic substrate material allows R1 as the combined magnetic resistance of the magnetic substrates to be smaller than R2 as the combined magnetic resistance of the non-magnetic layers. If Rm represents the combined magnetic resistance of a magnetic resistance circuit of the coil component including magnetic substrates and non-magnetic layers and the combined magnetic resistance of the non-magnetic layers R2 is made much larger than R1 which is the combined magnetic resistance of the magnetic substrates, then even in the case of using a material having large deviations of a relative permeability $\mu$R1 as a magnetic substrate material, the combined magnetic resistance of the coil component Rm is determined predominantly by the combined magnetic resistance of the non-magnetic layers R2, and Rm is not affected by fluctuations of the combined magnetic resistance of the magnetic substrates R1. Therefore, the inductance of the coil component does not change in any significant amount.

According to a second aspect of preferred embodiments of the present invention, in the case of using a magnetic substrate material having a relative permeability which varies within a range of about ±30% from a standard value, when an overall inductance of the coil component having a respective relative permeability of about +30% and about −30% is respectively indicated as L1.05 and L0.95, the relative permeability of the magnetic substrate material is set to the value that is not less than the relative permeability obtained when the ratio L1.05/L0.95 of the inductance is about 1.105. With this novel feature of this preferred embodiment of the present invention, even if a material of type in which a relative permeability $\mu$r1 of a magnetic substrate material varies within a range of about ±30% is used, an overall inductance of the coil component varies from the average value only within a range of about +5% at most and about −5% at least.

According to a third aspect of preferred embodiments of the present invention, R1/R2 which is the ratio of the combined magnetic resistance of the magnetic substrates R1 to the combined magnetic resistance of the non-magnetic layers R2 is preferably set to a value that is about 0.182 or less by using a formula:

$$\frac{1.05}{0.95} = \frac{R2 + R1/0.7}{R2 + R1/1.3}$$

The third aspect of preferred embodiments of the present invention is described based on the ratio of the combined magnetic resistance of the coil component, while the second aspect of preferred embodiments of the present invention is described based on the ratio of the inductance of the coil component. However, both of the aspects above provide the same results.

Other features and advantages of the present invention will become apparent from the following description of preferred embodiments of the present invention which refers to the accompanying drawings.

DETAILED DESCRIPTION OF PREFERRED EMBODIMENTS

A detailed description will be provided of preferred embodiments of the present invention, referring to FIGS. 1 through 5.

Figure 1:
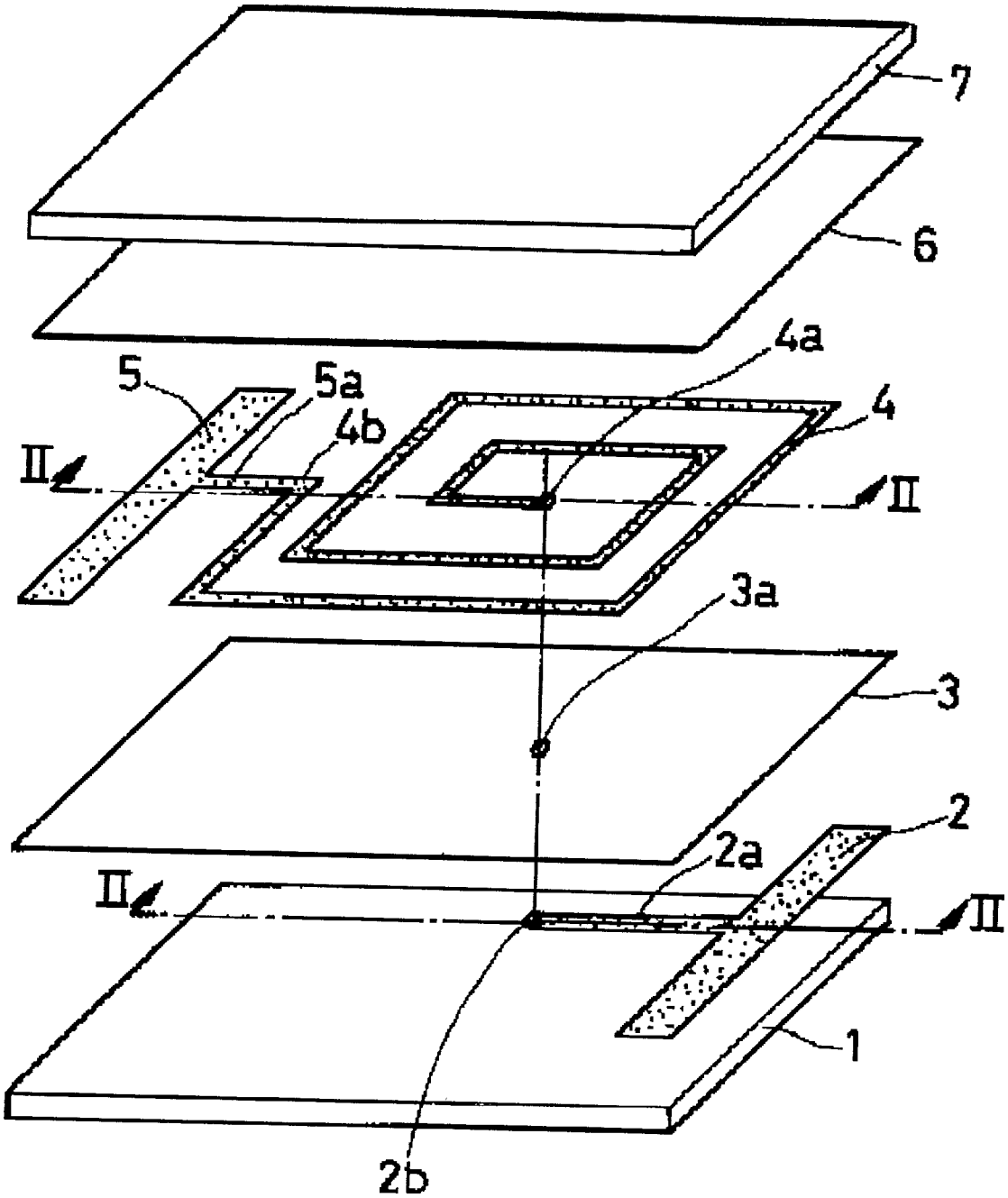
FIG. 1 is an exploded perspective view showing a coil component according to a preferred embodiment of the present invention.
Figure 2:
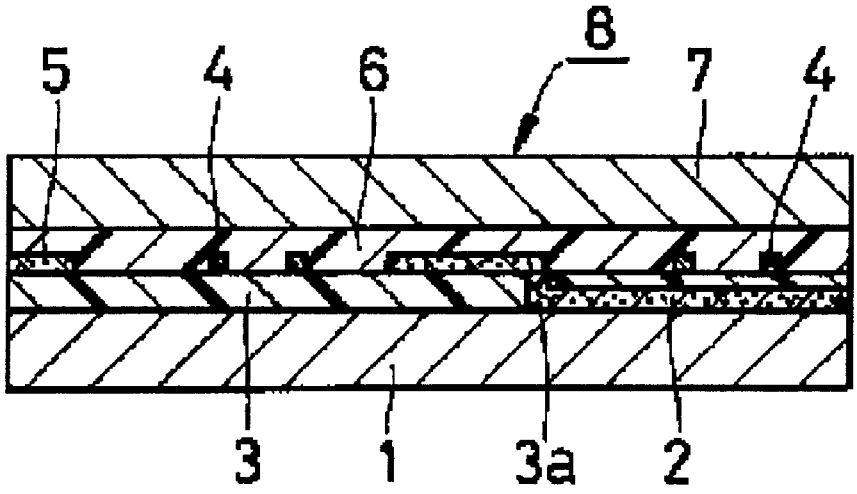
FIG. 2 is a sectional view of the coil component according to a preferred embodiment of the present invention, the section being taken along lines II—II of FIG. 1.

In FIGS. 1 and 2, there is shown an underlying magnetic substrate 1, which is preferably formed of a magnetic substrate material of an Ni—Zn ferrite.

Disposed by sputtering and photolithography on the surface of the magnetic substrate 1 are an outer leading electrode 2, which preferably has a film thickness of from about 1 μm to about 10 μm and is positioned at a shorter edge of the substrate 1, and a leading electrode 2*a* extending from the approximate center of the outer leading electrode 2 to the approximate center of the magnetic substrate 1. The outer leading electrode 2 and the leading electrode 2*a* are preferably formed of metals such as silver (Ag), aluminum (Al), gold (Au), copper (Cu), or the like; and portion 2*b* which is the top end of the leading electrode 2*a* defines a connection part for a via hole.

On the surface of the magnetic substrate 1 having the outer leading electrode 2 and the leading electrode 2*a*, there is arranged a non-magnetic layer 3 (an insulation layer), which is preferably formed of a photosensitive polyimide resin having a film thickness of about 5 μm, by spin coating or the like. A through-hole 3*a* for a via hole being guided to the top end 2*b* of the leading electrode 2*a* is preferably formed by photolithography. Besides a photosensitive polyimide resin, other resins such as epoxy resin, acrylic resin, cyclic olefin resin, benzocyclobutene resin can be used as a material of the non-magnetic layer 3.

On the surface of the non-magnetic layer 3, there are formed a spiral coil 4 preferably having a film thickness of from about 1 μm to about 10 μm, an outer leading electrode 5, and a leading electrode 5*a*, which are preferably formed by sputtering and photolithography. The outer leading electrode 5 is arranged opposite to the outer leading electrode 2 and positioned on the other shorter edge side of the magnetic substrate 1. The outer leading electrode 5*a* is formed on the non-magnetic layer 3 and extends to the approximate center of the magnetic substrate 1 from the approximate center of the outer leading electrode 5.

Furthermore, an inner end 4*a* of the coil 4 is connected by a via hole to the top end 2*b* of the leading electrode 2, passing through the through-hole 3*a* of the non-magnetic layer 3, while an outer end 4*b* of the coil 4 is connected to the top end of the leading electrode 5*a*.

On the surface of the non-magnetic layer 3 having the coil 4, the outer leading electrode 5, and the leading electrode 5*a*, there is arranged a non-magnetic layer 6, which is preferably formed of an adhesive polyimide resin having a film thickness of about 30 μm. The non-magnetic layer 6 is preferably formed by spin coating, screen printing or the like.

On the other hand, on the surface of the non-magnetic layer 6, there is attached a magnetic substrate 7 having the same quality of material and configuration as those of the underlying magnetic substrate 1, by using the adhesion of the polyimide resin. Alternatively, epoxy resin, acrylic resin, fluororesin, or the like, can also be used as a material for the non-magnetic layer 6.

FIG. 2 shows the sectional structure of a coil component 8 according to a preferred embodiment of the present invention. The coil component 8 has a structure in which the non-magnetic layers 3 and 6 surrounding the coil 4 are laminated between the magnetic substrate 1 at the base and the magnetic substrate 7 at the upper side.

Although the preferred embodiment described above uses the coil component 8 as a discrete component, if it is to be produced in mass quantity, it is possible to produce multiple pieces of the same by arranging identical coil components 8 in a matrix on a broad magnetic substrate so as to be made in bulk and diced.

Figure 3:
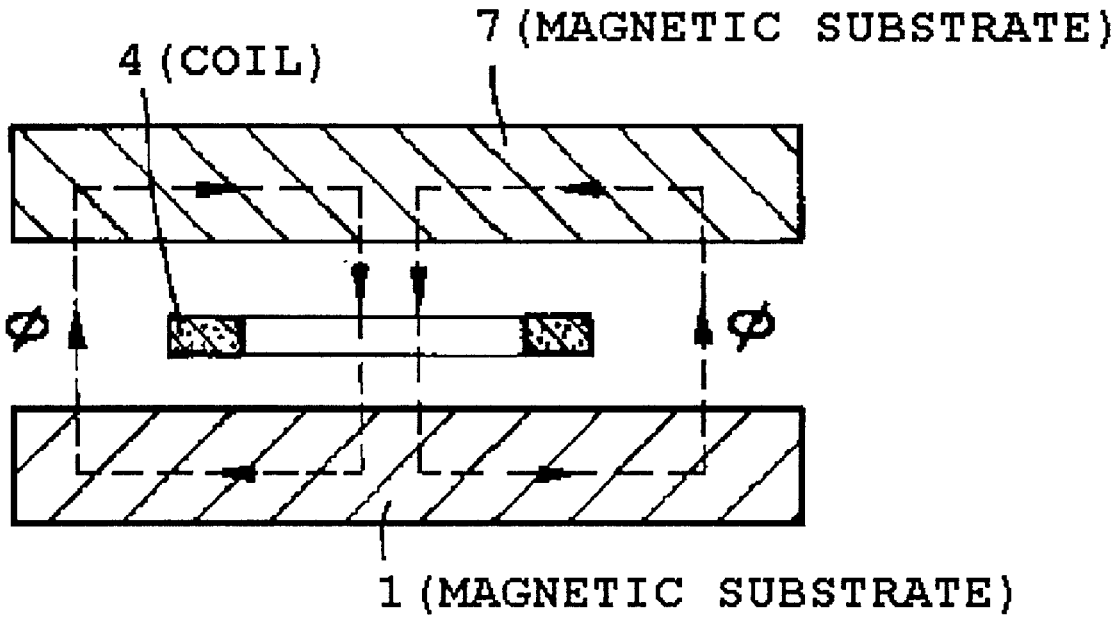
FIG. 3 is an equivalent magnetic circuit diagram of the coil component of preferred embodiments of the present invention.
Figure 4:
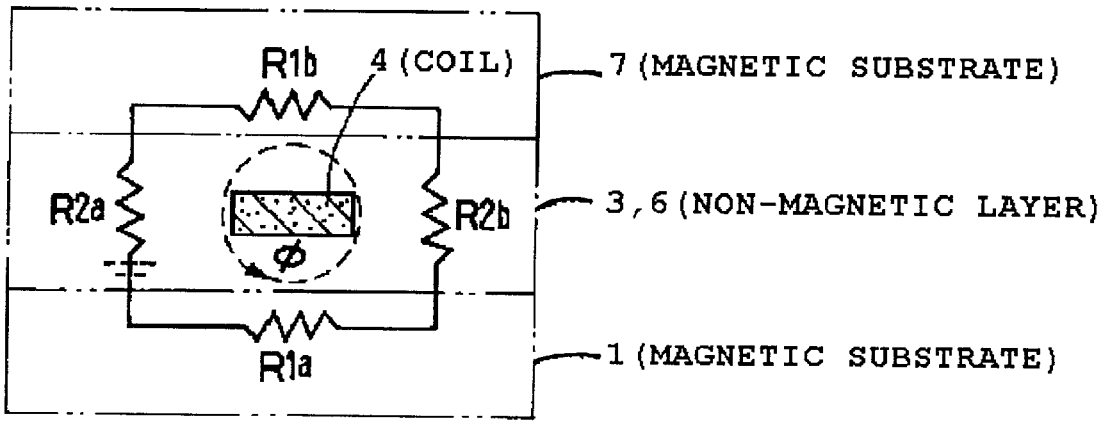
FIG. 4 is an equivalent combined magnetic resistance diagram of the coil component of preferred embodiments of the present invention.

In the preferred embodiment, a magnetic flux ø generated by the coil 4, or a magnetic circuit of the coil component 8 can be indicated by the broken lines in FIG. 3, wherein the coil 4 with multiple turns is wound while being concentrated at the center. FIG. 4 shows an equivalent magnetic resistance circuit of the magnetic substrates 1 and 7 and the non-magnetic layers 3 and 6. In this case, when the magnetic resistance of the magnetic substrates 1 and 7 is respectively represented by R1*a* and R1*b*, while magnetic resistances of the left sides and the right sides of the non-magnetic layers 3 and 6 being respectively represented by R2*a* and R2*b*, an equivalent combined magnetic resistance Rm of the coil component 8 is obtained by addition of R1*a*, R*b*, R2*a*, and R2*b* which are series magnetic resistances.

The magnetic resistance R1*a* of the magnetic substrate 1 and the magnetic resistance R1*b* of the magnetic substrate 7 can be regarded as substantially R1*a*=R1*b*. Similarly, the magnetic resistances R2*a* and R2*b* of the left sides and the right sides of the non-magnetic layers 3 and 6 can be regarded as substantially R2*a*=R2*b*. Thus, when the magnetic resistances R1*a* and R1*b* of the magnetic substrates 1 and 7 are represented in a consolidated form, they are indicated by R1*ab*, while the magnetic resistances R2*a* and R2*b* of the left sides and the right sides of the non-magnetic layers 3 and 6 are indicated by R2*ab* in a consolidated form.

Accordingly, in the preferred embodiment of the present invention, the following formula 1 shows respectively the combined magnetic resistance R1 as the sum of the respective magnetic resistances R1*a* and R1*b* of the respective magnetic substrates 1 and 7 and the combined magnetic resistance R2 as the sum of the magnetic resistances R2*a* and R2*b* of the left sides and the right sides of the non-magnetic layers 3 and 6.

$$R1=R1a+R1b \qquad \text{[Formula 1]}$$

$$R2=R2a+R2b$$

The relationship of the combined magnetic resistances R1 and R2 is set as shown in the following formula 2:

$$R2>R1 \qquad \text{[Formula 2]}$$

More specifically, the combined magnetic resistance R2 of the non-magnetic layers 3 and 6 is made larger than the combined magnetic resistant R1 of the magnetic substrates 1 and 7. This allow for variations in an inductance L of the coil component 8 caused by fluctuations of the relative permeability μr1 of the magnetic substrates 1 and 7 to be restricted to a low level.

Therefore, the following formula 3 provides the magnetic resistance R1*ab* of the magnetic substrates 1 and 7, the magnetic resistance R2*ab* of the non-magnetic layers 3 and 6, and the inductance L of the coil component 8.

$$R1ab=\frac{d}{\mu r1\times\mu o\times S} \qquad \text{[Formula 3]}$$

$$R2ab=\frac{t}{\mu r2\times\mu o\times S}$$

$$L=\frac{N\times N}{Rm}$$

d: length of magnetic path t: thickness of non-magnetic layer

μr1: relative permeability of magnetic substrate

μr2: relative permeability of non-magnetic layer

μo: permeability in a vacuum

S: cross-sectional area of magnetic path

N: number of turns of coil

Rm: sum of R1*a* and R1*b* as magnetic resistances of magnetic substrates, and R2*a* and R2*b* as magnetic resistances of non-magnetic layers (Rm=R1+R2)

These formulas show that the magnetic resistance R1*ab* of the material of the magnetic substrates 1 and 7 is directly proportional to the length d of the magnetic path, while being inversely proportional to the permeability $\mu r$1 and the cross-sectional area S of the magnetic path. Also, the magnetic resistance R2*ab* of the non-magnetic layers 3 and 6 is directly proportional to the thickness t of the non-magnetic layer of the magnetic path, while being inversely proportional to the permeability $\mu r$2 and the cross-sectional area S of the magnetic path.

Furthermore, the inductance L of the coil component 8 is directly proportional to the number N of turns of a coil to the 2nd power, while being inversely proportional to the equivalent combined magnetic resistance Rm. Concerning the series magnetic resistances R1*a*, R1*b*, R2*a*, and R2*b* which define the equivalent combined magnetic resistance Rm, when the relative permeability $\mu r$1 of the material of the magnetic substrates 1 and 7 is made larger while the combined magnetic resistance: R1=(R1*a*+R1*b*) is made smaller, the equivalent combined magnetic resistance Rm is predominantly determined by the combined magnetic resistance: R2=(R2*a*+R2*b*) of the non-magnetic layers 3 and 6. As a result, even if the relative permeability $\mu r$1 of the material of the magnetic substrates 1 and 7 varies, the inductance of the coil component 8 does not vary greatly, so that it can be maintained to a substantially specified value.

Figure 5:
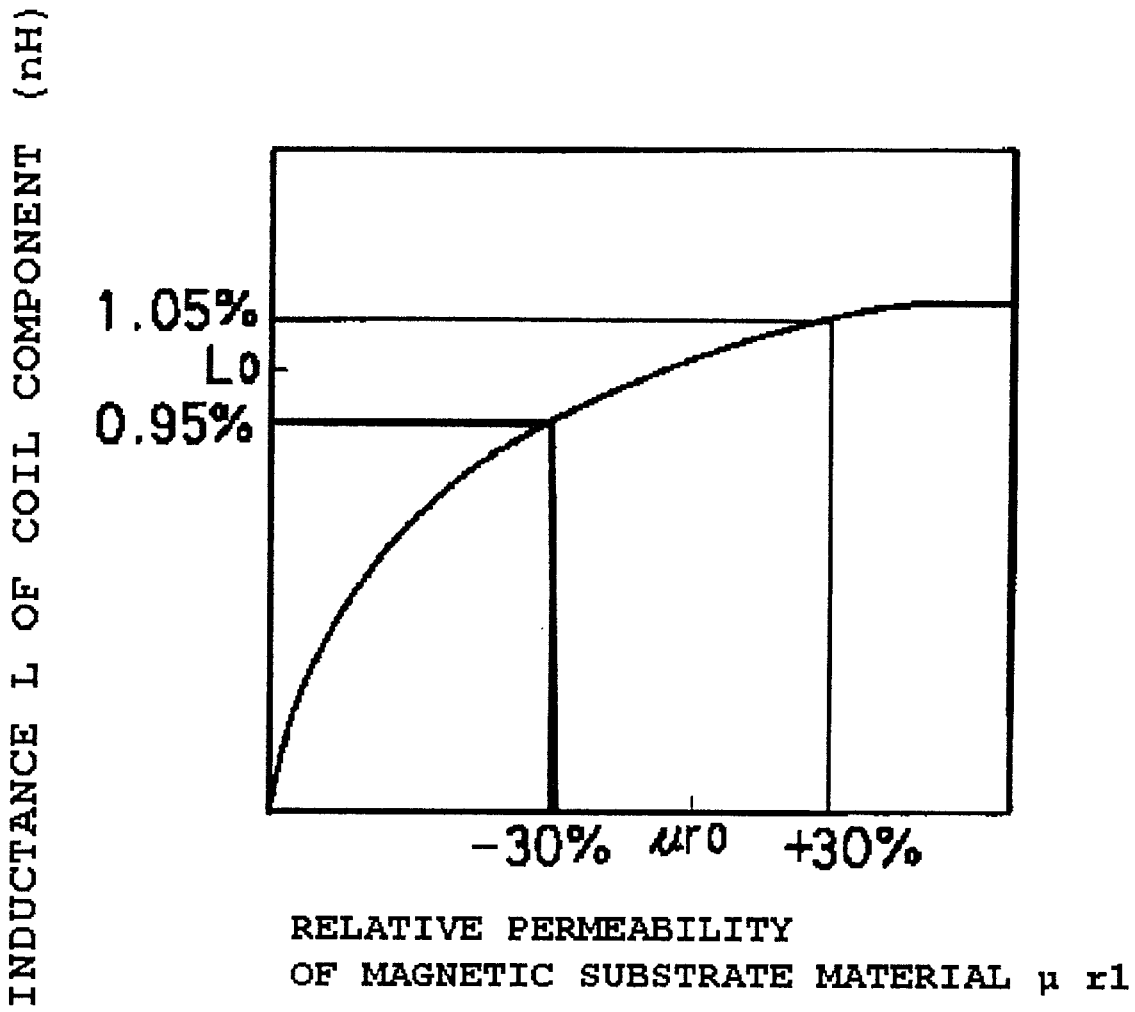
FIG. 5 is a characteristic graph of inductance of a coil component to relative permeability of a magnetic substrate.

FIG. 5 shows, in the preferred embodiment above, the characteristics of the inductance L of the coil component 8 with respect to the relative permeability $\mu r$1 of the material of the magnetic substrates 1 and 7.

In the characteristic graph of FIG. 5, there is shown a curve indicating that the inductance L of the coil component 8 increases sharply when the relative permeability $\mu r$1 of the material of the magnetic substrates 1 and 7 becomes large, and then becomes saturated halfway through the course.

Here, it is assumed that the relative permeability $\mu r$1 of the material of the magnetic substrates 1 and 7 varies within a range of about ±30% with respect to a center relative permeability $\mu r$0 of the standard value; L0 is the average inductance of L1.05 and L0.95; and when the relative permeability $\mu r$1 of the material of the magnetic substrates 1 and 7 is about −30%, the inductance L is about 0.95L0 [nH] (L0.95), while when the relative permeability $\mu r$1 is about +30%, the inductance L is about 1.05L0 [nH] (L1.05).

In preferred embodiments of the present invention, the relative permeability $\mu r$1 of the material of the magnetic substrates 1 and 7 is preferably set to a value that is not smaller than the relative permeability $\mu r$0 of the material of the magnetic substrates 1 and 7 obtained when the ratio of the inductance L (L1.05/L0.95)=1.05L0 [nH]/0.95L0 [nH] is about 1.105.

Also, in preferred embodiments, the ratio R1/R2 of the combined magnetic resistance of the magnetic substrates 1 and 7 with respect to the combined magnetic resistance R2 of the non-magnetic layers 3 and 6 is set to a value that is about 0.182 or less, which is calculated by the following formula 4:

$$\frac{1.05}{0.95} = \frac{R2 + R1/0.7}{R2 + R1/1.3} \quad \text{[Formula 4]}$$

As described above, in the coil component 8 having a structure in which the non-magnetic layers 3 and 6 surrounding the coil 4 are laminated between the pair of magnetic substrates 1 and 7, the relative permeability $\mu r$1 of the material of the magnetic substrates 1 and 7 is set to a value that is not smaller than the relative permeability $\mu r$0 obtained when a deviation of the inductance L of the coil component 8 as a product is about ±5%. More specifically, a ratio of the maximum and minimum deviations in the variations of the inductance L is preferably about 1.105.

Also, the ratio R1/R2 of the combined magnetic resistance of the magnetic substrates 1 and 7 with respect to the combined magnetic resistance R2 of the non-magnetic layers 3 and 6 is preferably set to a value that is a specific desired value (about 0.182) or less. As a result, by the saturating characteristics of the inductance L with respect to the relative permeability $\mu r$1 as shown in FIG. 5, the deviations of the overall inductance L of the coil component are restricted to fall within a range of about ±5%, even if the material of the magnetic substrate is of a type in which the relative permeability $\mu r$1 varies within a range of about ±30%.

The coil component 8 above preferably includes, besides a coil, a transformer, a balun, a common-mode choke coil, and an inductor for noise reduction, etc.

According to the first aspect of preferred embodiments of the present invention, the use of a magnetic substrate material having a relative permeability that is a specified value or more allows the combined magnetic resistance of the magnetic substrate to be smaller than the combined magnetic resistance of the non-magnetic layers. This permits the overall inductance of the coil component to be predominantly determined by the non-magnetic layers, even if the magnetic substrate material is of a class in which the relative permeability varies greatly, so that the inductance of the coil component can be maintained to a substantially specified value.

In the second and third aspects of preferred embodiments of the present invention, in addition to the advantages achieved by the first aspect above, another advantage is achieved in that, even if the magnetic substrate material is of a type in which the relative permeability varies within a range of about ±30%, it is possible to produce a coil component as a product with deviations of inductance varying only within a range of about +5% at most and about −5% at least.

While the invention has been particularly shown and described with reference to preferred embodiments thereof, it will be understood by those skilled in the art that the forgoing and other changes in form and details may be made therein without departing from the spirit of the invention.

What is claimed is:

1. A coil component, comprising:

a pair of magnetic substrates;

a plurality of non-magnetic layers;

a coil, the coil and the non-magnetic layers being laminated between said magnetic substrates, the non-magnetic layers being disposed between the pair of magnetic substrates, such that a magnetic resistance of each magnetic substrate of the pair of magnetic substrates causes a magnetic resistance to be generated in the non-magnetic layers; and a closed series magnetic circuit including said pair of magnetic substrates and said non-magnetic layers and being defined by magnetic resistances of the magnetic substrates and magnetic resistances generated in the non-magnetic layers; wherein a relative permeability of a material of said pair of magnetic substrates is set such that a combined magnetic resistance R1 of said pair of magnetic substrates and a combined magnetic resistance R2 of said non-magnetic layers satisfy a relationship: R2>R1;

the relative permeability of said material of said pair of magnetic substrates deviates from a desired value by about +30%, and an overall inductance of the coil component including the material of said pair of magnetic substrates having the relative permeability of about +30% and about −30% is respectively indicated as L1.05 and L0.95, wherein L is an average inductance value, the relative permeability of said magnetic substrate material is set to a value that is equal to or greater than the relative permeability obtained when the ratio of L1.05/L0.95 of the inductance is about 1.105; and a ratio R1/R2 is about 0.182 or less.

2. A coil component according to claim 1, wherein the ratio R1/R2 is determined by a formula:

$$\frac{1.05}{0.95} = \frac{R2 + R1/0.7}{R2 + R1/1.3}.$$

3. A coil component according to claim 1, wherein the magnetic substrates are made of a Ni—Zn ferrite material.

4. A coil component according to claim 1, further comprising an electrode formed on one of the magnetic substrates.

5. A coil component according to claim 4, wherein the electrode is electrically connected to the coil.

6. A coil component according to claim 4, wherein the electrode is formed of a metal including at least one of silver, aluminum gold and copper.

7. A coil component according to claim 1, wherein the non-magnetic layers are formed of a material selected from the group consisting of a photosensitive polyimide resin, an epoxy resin, an acrylic resin, a cyclic olefin resin and a benzocyclobutene resin.

8. A coil component according to claim 1, wherein the non-magnetic layer has a film thickness of about 5 $\mu$m.

9. A coil component according to claim 1, wherein the coil has a film thickness of about 1 $\mu$m to about 10 $\mu$m.

10. A coil component according to claim 1, wherein a magnetic resistance of the magnetic layers is equal.

11. A coil component according to claim 1, wherein a relative permeability $\mu r$1 of the material of the magnetic substrates is set to age that is not smaller than the relative permeability $\mu r$0 obtained when a deviation of the inductance L of the coil component is about ±5%.

12. A coil component according to claim 1, wherein a ratio of a maximum and a minimum deviation in variations of the inductance L is about 1.105.

* * * * *